US007077265B2

(12) United States Patent
Laarman

(10) Patent No.: US 7,077,265 B2
(45) Date of Patent: Jul. 18, 2006

(54) SLEEVE ASSEMBLY FOR DIGITAL MEDIA DISK

(75) Inventor: Lisa Laarman, Seattle, WA (US)

(73) Assignee: Starbucks Corporation, Seattle, WA (US)

( * ) Notice: Subject to any disclaimer, the term of this patent is extended or adjusted under 35 U.S.C. 154(b) by 60 days.

(21) Appl. No.: 10/965,275

(22) Filed: Oct. 13, 2004

(65) Prior Publication Data

US 2005/0199516 A1 Sep. 15, 2005

Related U.S. Application Data

(63) Continuation-in-part of application No. 10/800,811, filed on Mar. 15, 2004, now Pat. No. 6,942,092.

(51) Int. Cl.
*B65D 85/57* (2006.01)

(52) U.S. Cl. ..... 206/232; 206/308.1; 206/312

(58) Field of Classification Search ..... 206/232, 206/308.1, 309–313, 387.1, 387.13; 281/31, 281/38, 45, 49; 402/3, 71, 73
See application file for complete search history.

(56) References Cited

U.S. PATENT DOCUMENTS 5,215,398 A * 6/1993 White et al. ..... 402/73
5,513,749 A * 5/1996 Simmons ..... 206/308.1
5,542,531 A * 8/1996 Yeung ..... 206/308.1
5,655,656 A * 8/1997 Gottlieb ..... 206/308.1
5,697,496 A 12/1997 Bauer
5,839,575 A 11/1998 Blanco
5,947,281 A 9/1999 Kaneff
6,202,839 B1 * 3/2001 Petersen et al. ..... 206/308.1
6,241,085 B1 6/2001 Koehn
6,540,071 B1 * 4/2003 Liu ..... 206/308.1
6,612,433 B1 9/2003 McKenzie
6,637,588 B1 10/2003 Stamer

* cited by examiner

*Primary Examiner*—Luan K. Bui
(74) *Attorney, Agent, or Firm*—Christensen O'Connor Johnson Kindness PLLC

(57) ABSTRACT

A sleeve assembly (200, 300) for a digital media disk (90) or similar flat product is disclosed. The sleeve assembly includes a sleeve member (210, 370/380) having a plurality of hingedly connected panels (216, 226, 236, 316, 336), wherein one or more of the panels includes apertures (212, 312). Two of the panels include retaining members (221, 231, 321, 331). In some embodiments, a semirigid disk holder (141) is attached to a panel, for retaining the disk. A removable placard (260), having identifying indicia (262, 264) that is at least partially visible through the apertures, and is removably retained by the retaining members. In some embodiments, an aperture (214) is included on the hinge spine, such that a portion of the placard can be seen from the end of a folded sleeve assembly. The sleeve member may be generic, while the placard includes specific indicia related to the received disk.

15 Claims, 11 Drawing Sheets

380
312
300
241
321
370
316
331
336
260
262
264
GREATEST HITS 2

300
380
312
262
264
260
GREATEST HITS 2

SLEEVE ASSEMBLY FOR DIGITAL MEDIA DISK

CROSS-REFERENCE TO RELATED APPLICATION

This application is a continuation-in-part of prior application Ser. No. 10/800,811, filed Mar. 15, 2004 now U.S. Pat. No. 6,942,092, priority from the filing date of which is hereby claimed under 35 U.S.C. § 120.

FIELD OF THE INVENTION

The invention relates generally to packaging systems and, in particular, to packaging for flat products such as compact disks and digital video disks.

BACKGROUND OF THE INVENTION

Digital information/entertainment products are increasingly being distributed on flat storage media, such as compact disks ("CDs"), digital video disks ("DVDs"), and the like. For example, music, music videos, movies, software, photographs, promotional materials such as catalogues and directories are commonly produced and distributed on CDs and/or DVDs. CDs, DVDs, and similar flat storage media are collectively referred to herein as "digital media disks." Digital media disks have many advantages over other prior art storage media. They are relatively easy and inexpensive to produce, flexible to modify and format, and provide a convenient form factor. Although the most common digital media disks are circular with a diameter of about 12 cm, digital media disks having different sizes and/or shapes are also available. Digital media disks are generally amenable to external markings—for example, to identify the digital content stored on the media and/or to provide other aesthetic, promotional, and/or informational content. Players for the various types of digital media disks are becoming ubiquitous.

The packaging of music CDs, for example, frequently includes a hard, transparent or semitransparent, plastic case, often called a "jewel case." An insert or placard is frequently insertable into the jewel case, providing identifying indicia indicating the content of the CD. The insert may include other information, such as a play list, lyrics, copyright notice, content warnings or ratings, and credits such as the various artists and producers involved in producing the CD.

The conventional jewel case, however, has some disadvantages. The jewel case is relatively thick and heavy, with many hard corners. This may make the jewel case (and enclosed CD) inconvenient to carry around, such as in a pocket or backpack. The jewel case is also typically formed of a brittle, hard plastic that is susceptible to scratching and breakage. For example, the jewel case may break when dropped or otherwise mishandled and, in particular, the integral hinge mechanism is susceptible to damage. The jewel case also can be difficult to open. The jewel case also typically includes an engagement member that extends through the center hole in the CD and clasps the CD to secure it to the case and prevent it from accidentally falling out while the jewel case is being opened. Such engagement members, however, may further complicate removal of the CD and, in particular, may result in damage to the CD—for example, if the user attempts to remove the CD by pulling upwardly on an outer edge without first disengaging the mechanism. Such jewel cases are also relatively expensive to produce.

Other cases for CDs have been proposed that overcome some of the jewel case disadvantages discussed above, utilizing paperboard material to form the carrier. For example, U.S. Pat. No. 5,655,656 discloses a two-piece sleeve package for compact disks made from paperboard card stock, having an outer container and a separable inner sleeve that slidably engages the outer container. U.S. Pat. No. 6,241,085 discloses a folded paperboard CD carrier for holding a plurality of CDs in a side-by-side arrangement. U.S. Pat. No. 6,637,588 discloses a folded paperboard CD carrier having a folded panel including a protrusion that is adapted to be inserted through the center aperture of the CD. However, these carriers are relatively complex. Moreover, because paperboard is opaque, the user cannot readily identify the content of the enclosed CD without opening the carrier.

There remains a need, therefore, for a carrier for digital media disks such as CDs and DVDs that is relatively simple and easy to produce, and easy to open for removing a digital media disk.

SUMMARY OF THE INVENTION

A sleeve assembly for a digital media disk such as a compact disk, digital video disk, or the like, is disclosed. The sleeve assembly allows the use of a generic sleeve member that does not have product-specific indicia, in combination with a placard that is removably retained therewith, the placard having product-specific indicia. At least a portion of the identifying indicia is visible through one or more apertures in the sleeve assembly, even when the sleeve assembly is in a closed configuration. The sleeve assembly includes a multipanel sleeve member, such as a three-panel, trifold type sleeve, wherein a first and second panel each includes a retaining member for retaining the placard having identifying indicia printed thereon. One or both of the first and second panels have apertures that are positioned to expose at least a portion of the identifying indicia on the placard. A third panel includes a pocket that opens inwardly or other retaining device that is adapted to receive a digital media disk such that the disk is securely retained in the sleeve when the sleeve assembly is folded to a closed position.

In an embodiment of the invention, an aperture is provided, disposed generally between the first and second panels, whereby when the sleeve assembly is closed, the aperture extends across the spine of the fold to expose a portion of the placard that is viewable from the end of the sleeve assembly. This may allow the user to identify a particular disk from a stack of similar disks.

In an embodiment of the invention, the sleeve assembly includes a multipanel sleeve having a first sleeve panel with a first retaining member, a second sleeve panel with a second retaining member, the first sleeve panel hingedly connected to the second sleeve panel along a sleeve spine. Means for releasably attaching a digital media disk to the multipanel sleeve are included. A placard is provided having identifying indicia printed thereon. The placard is sized to engage the first and second retaining members such that the placard is removably retained on the sleeve and at least a portion of the identifying indicia is viewable through a viewing aperture through the multipanel sleeve when the sleeve is closed.

In an embodiment of the invention, the sleeve assembly includes a hinged portion that retains the placard on an outer surface and a separable box portion that receives the hinged portion, and includes apertures through which at least a portion of the identifying indicia is viewable.

The present invention includes a method for packaging a digital media disk including the steps of providing a multi-panel sleeve including means for retaining a digital media disk, the sleeve having at least one viewing aperture therethrough, retaining the disk in the sleeve, printing a placard having identifying indicia associated with the digital media disk, and retaining the placard on the sleeve such that the identifying indicia is visible through the viewing aperture.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
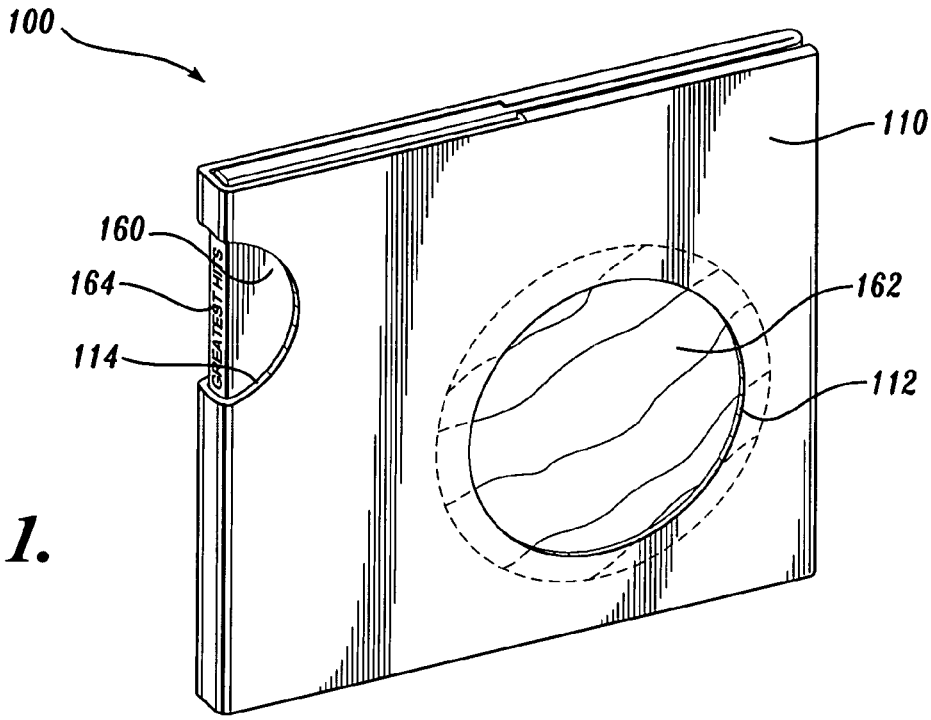
FIG. 1 is a perspective view of an embodiment of a sleeve assembly for a digital media disk, shown in the folded configuration and made in accordance with the present invention.

A currently preferred embodiment of the present invention will now be described with reference to the figures, wherein like numbers indicate like parts. FIG. 1 is a perspective view of an assembled digital media disk sleeve assembly 100 shown in a closed, or folded, configuration. The sleeve assembly 100 includes a sleeve member 110 that is preferably die-cut from a sheet of paperboard, as discussed in detail below. The sleeve member 110 includes a front aperture 112 and a spine aperture 1 14. A removable placard 160 (partially visible in FIG. 1) is disposed generally inside the folded sleeve member 110 and includes a portion that is visible through the front aperture 112 and the spine aperture 114 of the sleeve member 110. The placard 160 may include first identifying indicia 162 printed or otherwise disposed on the placard to be visible through the front aperture 112, and second identifying indicia 164 printed or otherwise disposed on the placard 160 to be visible through the spine aperture 114.

Figure 2A:
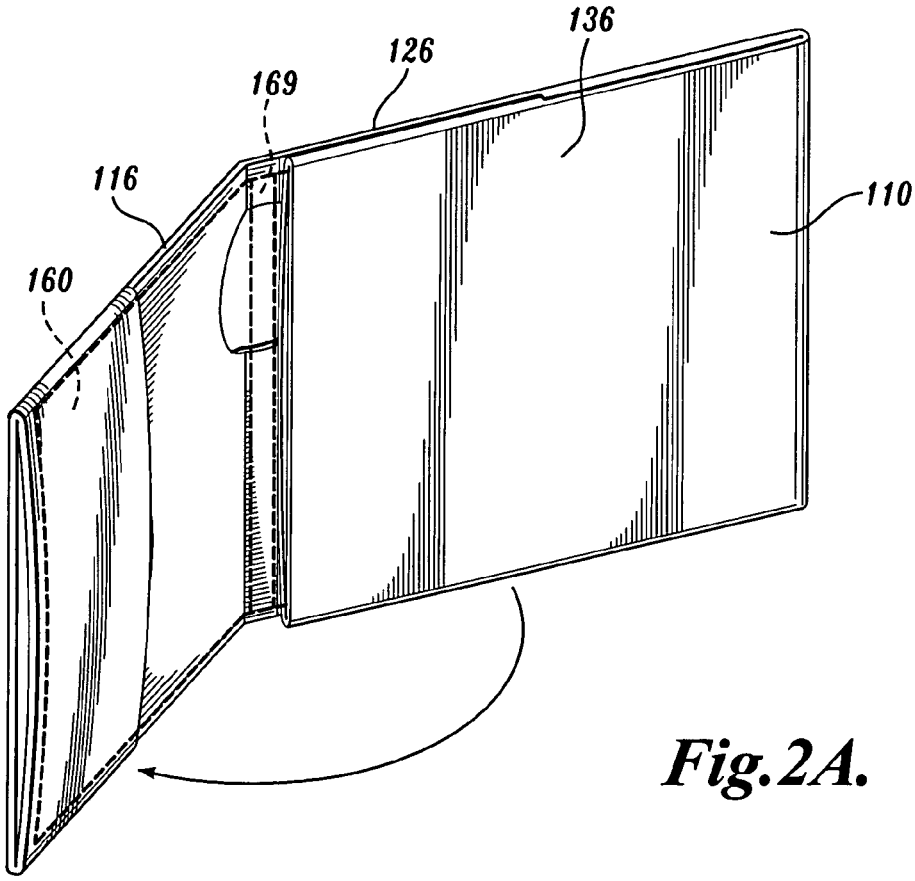
FIGS. 2A and 2B show the sleeve assembly of FIG. 1, partially and then substantially fully open.
Figure 2B:
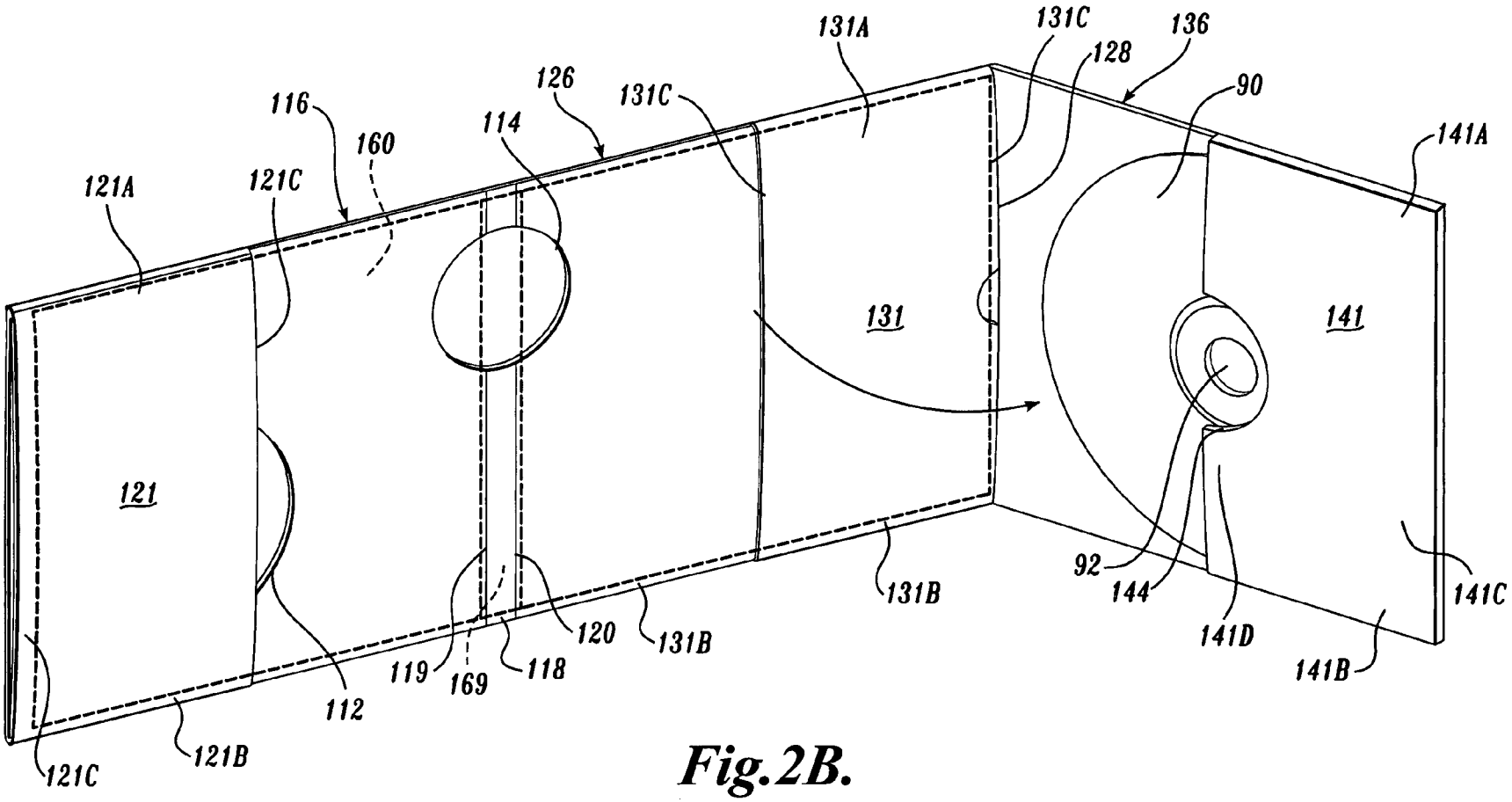

FIG. 2A shows the sleeve assembly 100 partially opened and FIG. 2B shows the sleeve assembly 100 substantially fully opened, with the placard 160 shown in phantom to expose details of the sleeve member 110 and arrows included to show the unfolding sequence. The sleeve assembly 100 is shown having a three-panel or "trifold" configuration. It is contemplated, however, that the present invention may be readily practiced using a four-panel or more than four-panel sleeve assembly in a straightforward manner without departing from the present invention and may be readily adapted to hold more than one digital media disk.

As seen most clearly in FIG. 2B, the sleeve member 110 includes a first end panel 116, a middle panel 126, and a second end panel 136. The first end panel 116 is hingedly connected to the middle panel 126 through hinge portion 118, which is preferably formed by two closely-spaced, parallel folds 119, 120. A first retaining member 121 overlies and generally conforms to the distal portion of the first end panel 116. The first retaining member 121 is connected to the first end panel 116 at the top edge 121A and bottom edge 121B, and is free or open on the sides 121C such that a flat channel or opening is formed between the first retaining member 121 and the first end panel 116.

The middle panel 126 is also hingedly connected to the second end panel 136 through hinge portion 128, which is preferably formed by a single transverse fold. The middle panel 126 includes a second retaining member 131 opposite the first retaining member 121 and disposed generally adjacent to the second end panel. The second retaining member 131 is connected to the middle panel 126 at the top edge 131A and bottom edge 131B, and free on the sides 131C, such that a flat channel or opening is formed between the second retaining member 131 and the middle panel 126.

The second end panel 136 includes a pocket member 141 disposed at the distal end of the second end panel 136. The pocket member 141 is connected to the second end panel 136 at a top edge 141A, bottom edge 141 B, and distal side edge 141C, and open at the proximal side edge 141D, to form a pocket. The pocket is sized to slidably receive a digital media disk 90. The proximal edge 141D of the pocket member 141 may include a semicircular cutout 144 that is positioned to expose the central aperture 92 of the digital media disk 90 to permit a user to remove the disk 90 by inserting a finger into the aperture 92 to slide the disk 90 outwardly, away from the pocket.

The hinge portion 118 between the first end panel 116 and the middle panel 126 is wider than the hinge portion 128 between the middle panel 126 and the second end portion 136, such that when the sleeve assembly 100 is folded or closed, as shown in FIG. 1, the hinge portion 118 will accommodate the thickness of the second end panel 136, including the digital media disk 90.

Figure 3:
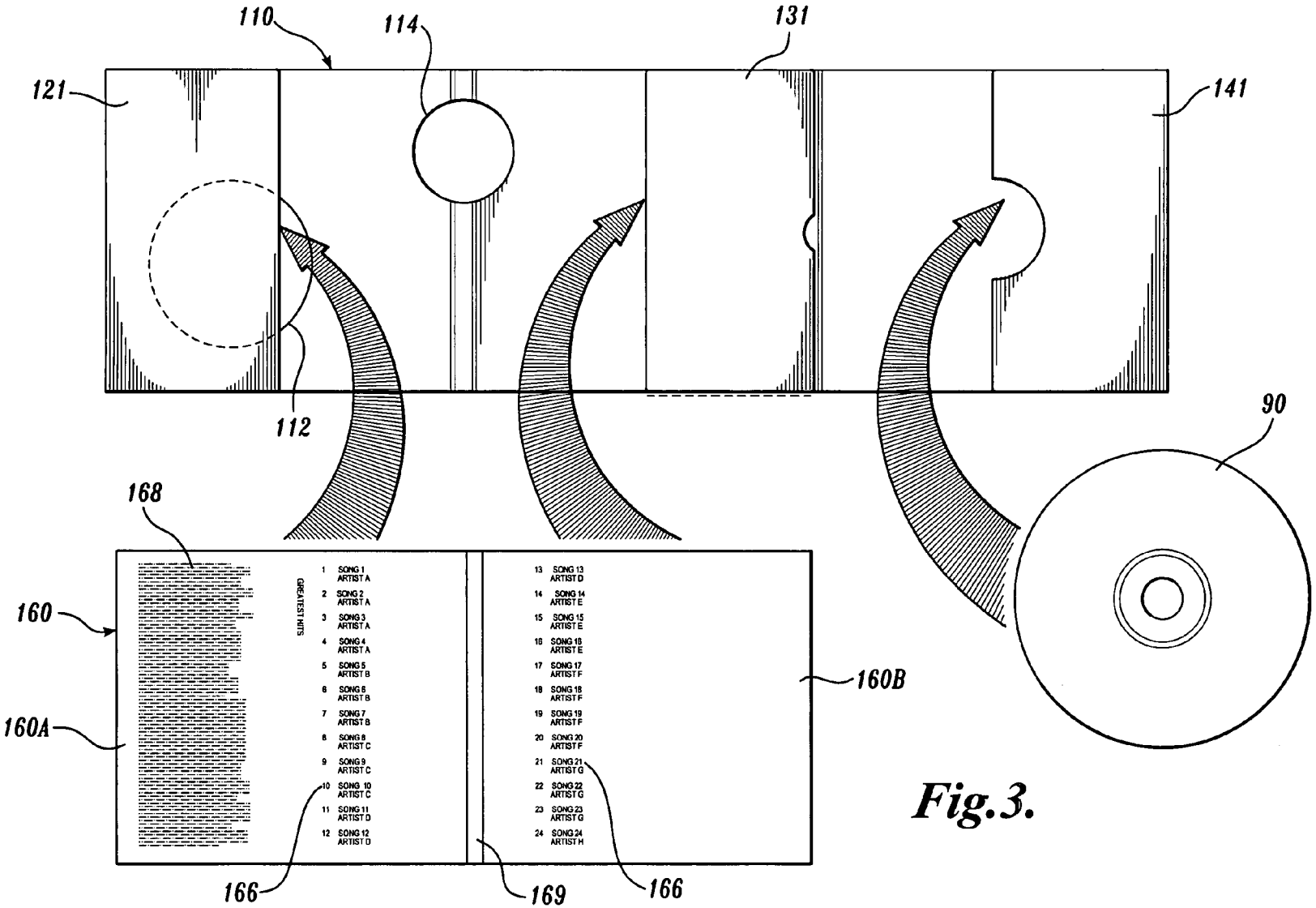
FIG. 3 is an exploded view of the sleeve assembly shown in FIG. 1, showing insertion of the placard and the digital media disk.

It will be appreciated from FIG. 3 that the placard 160 is sized to overlie the combined first end panel 116 and middle panel 126 such that the opposite end portions 160A, 160B of the placard 160 may be slidably inserted in the respective flat channels formed by the first and second retaining members 121, 131. In particular, the placard 160 is a flexible, simple paperboard panel wherein the left end 160A may be inserted underneath the first retaining member 121 and the right end 160B may be inserted underneath the second retaining member 131. The placard 160 may then be slidably adjusted to generally overlie the first end panel 116 and the middle panel 118 of the sleeve member 110. The digital media disk 90 is inserted into the pocket formed by the pocket member 141. The placard 160 includes a center hinge portion 169 that overlies the sleeve member hinge portion 118.

Figure 4A:
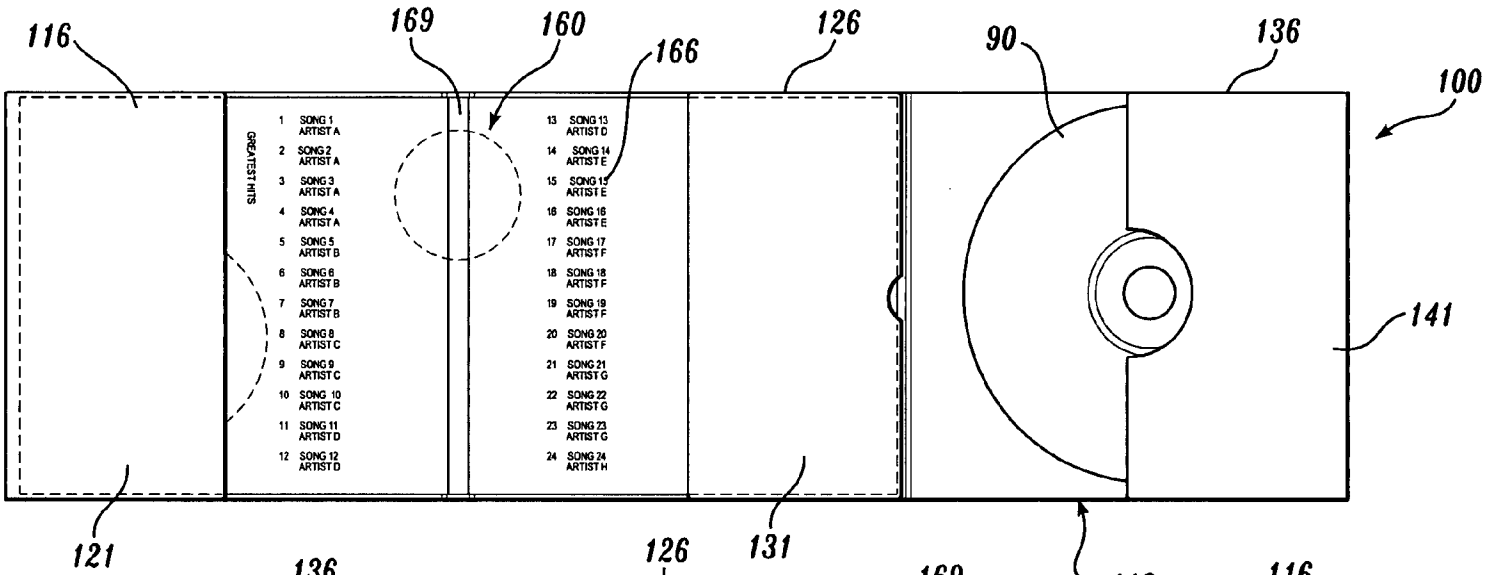
FIGS. 4A and 4B show front and back views of the sleeve assembly shown in FIG. 1, wherein the sleeve assembly is fully open.
Figure 4B:
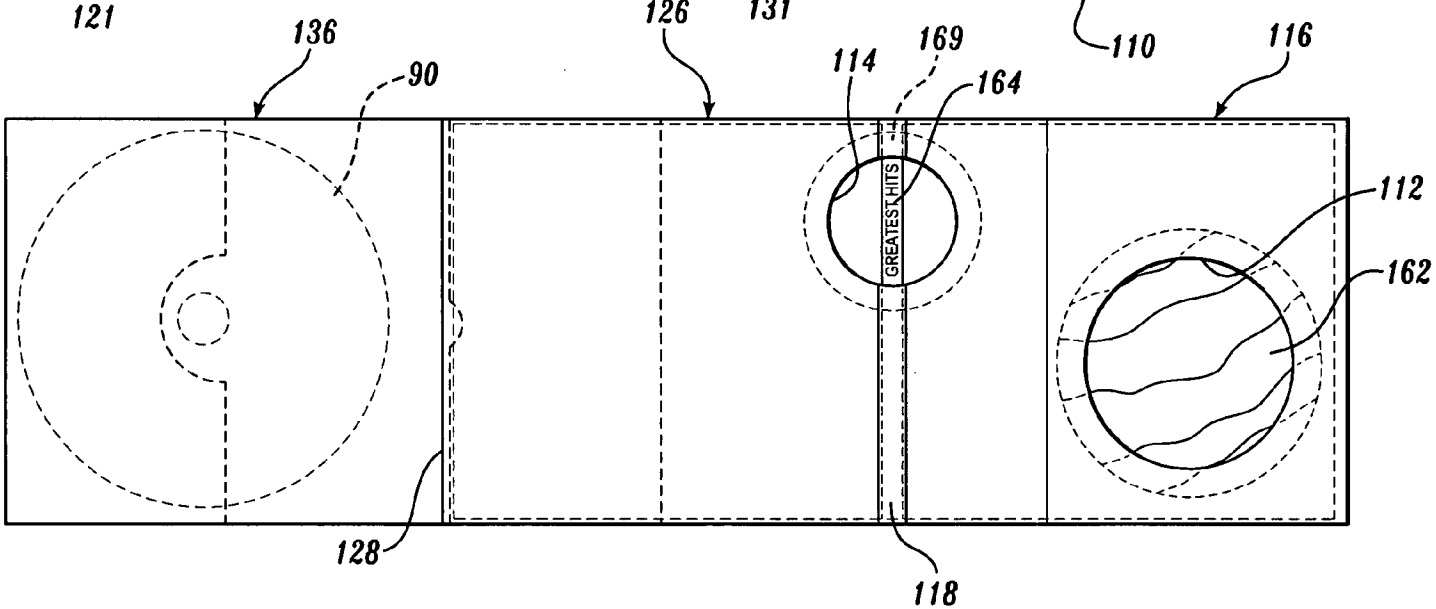

FIG. 4A shows a front view of the open, assembled sleeve assembly 100 and FIG. 4B shows a rear view of the sleeve assembly 100. It is contemplated that the front of the placard 160 may include a third identifying indicia 166 suitable for the particular digital media disk—for example, a play list, user instructions, included features, copyright notice, or other product information. It is also contemplated that a fourth identifying indicia 168 may be printed one or both of the end portions 160A, 160B of the placard 160 that are obscured by the first and second retaining members 121, 131. For example, it may be aesthetically desirable to put rarely accessed information or semiprivate information on the end portions 160A, 160B of the placard 160.

Referring now to FIG. 4B, the back side of the placard 160 includes first and second identifying indicia 162, 164 that are positioned to be visible through the front aperture 112 and spine aperture 114, respectively, when the placard 160 is in the desired position. It will now be appreciated that, in the preferred embodiment, the sleeve member 110 does not include any printed information or other indicia that is particular to the specific digital media disk 90 and, therefore, the sleeve member may be generically used with different disks. For example, identical sleeve members 110 may be used with a whole collection of different music CDs, which may result in significant manufacturing and cost reductions. It is contemplated, however, that the sleeve member 110 might include generic information, such as by printing, embossing, or otherwise, such as a house trademark, manufacturer or distributor identification, commercial information, or aesthetic markings. The placard 160 contains identifying indicia that may be specific to the digital media disk 90 with which it is associated. The placard 160 is preferably a simple rectangular, flat piece of paperboard that is easily printed on. Moreover, the first and second identifying indicia 162, 164 may be printed on only the relatively small portion of the back side of the placard 160 that is visible through the apertures 112, 114 of the sleeve member 110.

Figure 5:
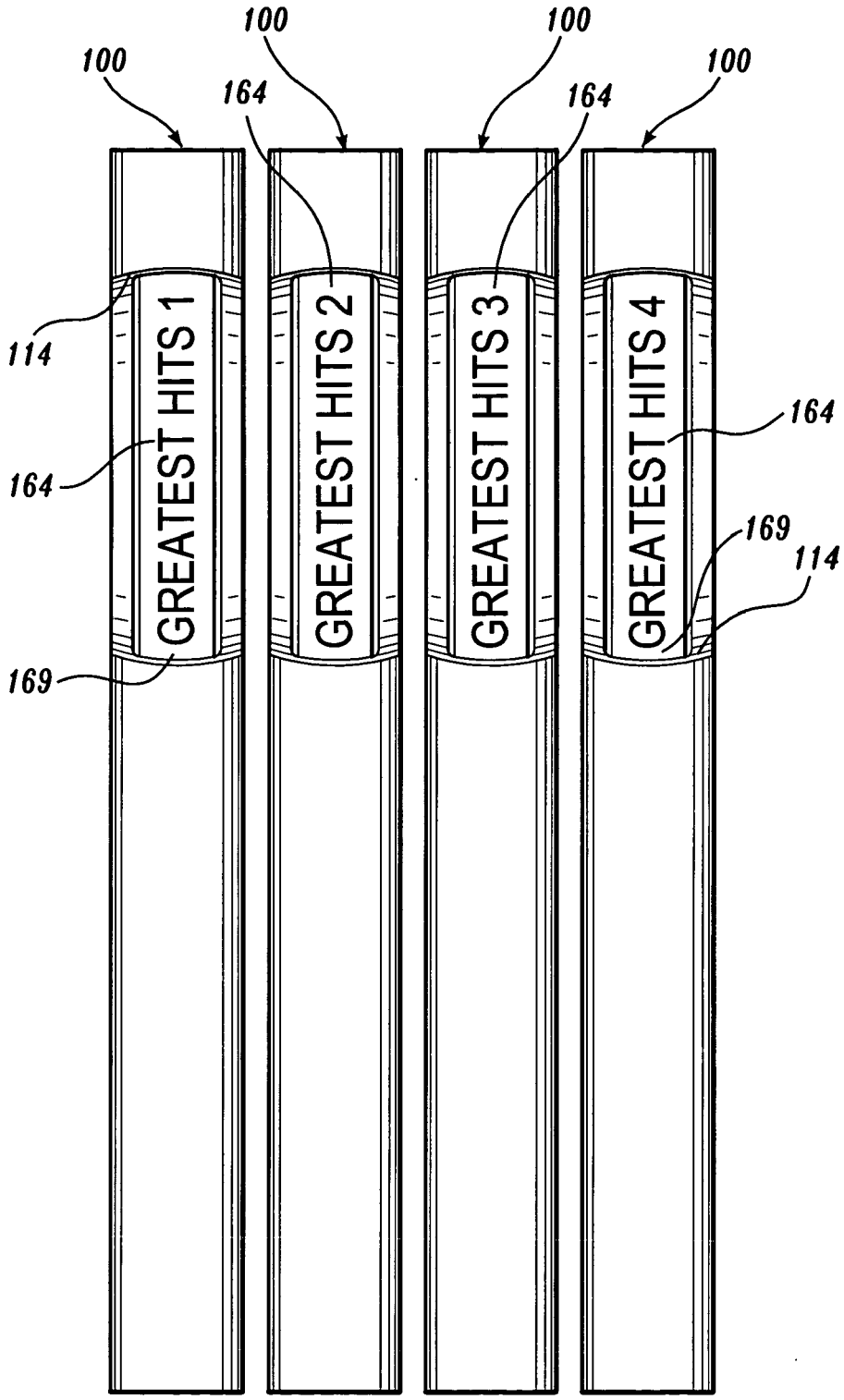
FIG. 5 is an end view showing a number of assembled sleeve assemblies.

In particular, it will be appreciated from FIG. 5 that the second identifying indicia 164, visible through the spine aperture 114, permits a user to identify and select a particular digital media disk (not shown) even when a plurality of sleeve assemblies 100 is stacked or otherwise having only the edge characterized by the hinge portion 118 visible.

Figure 6:
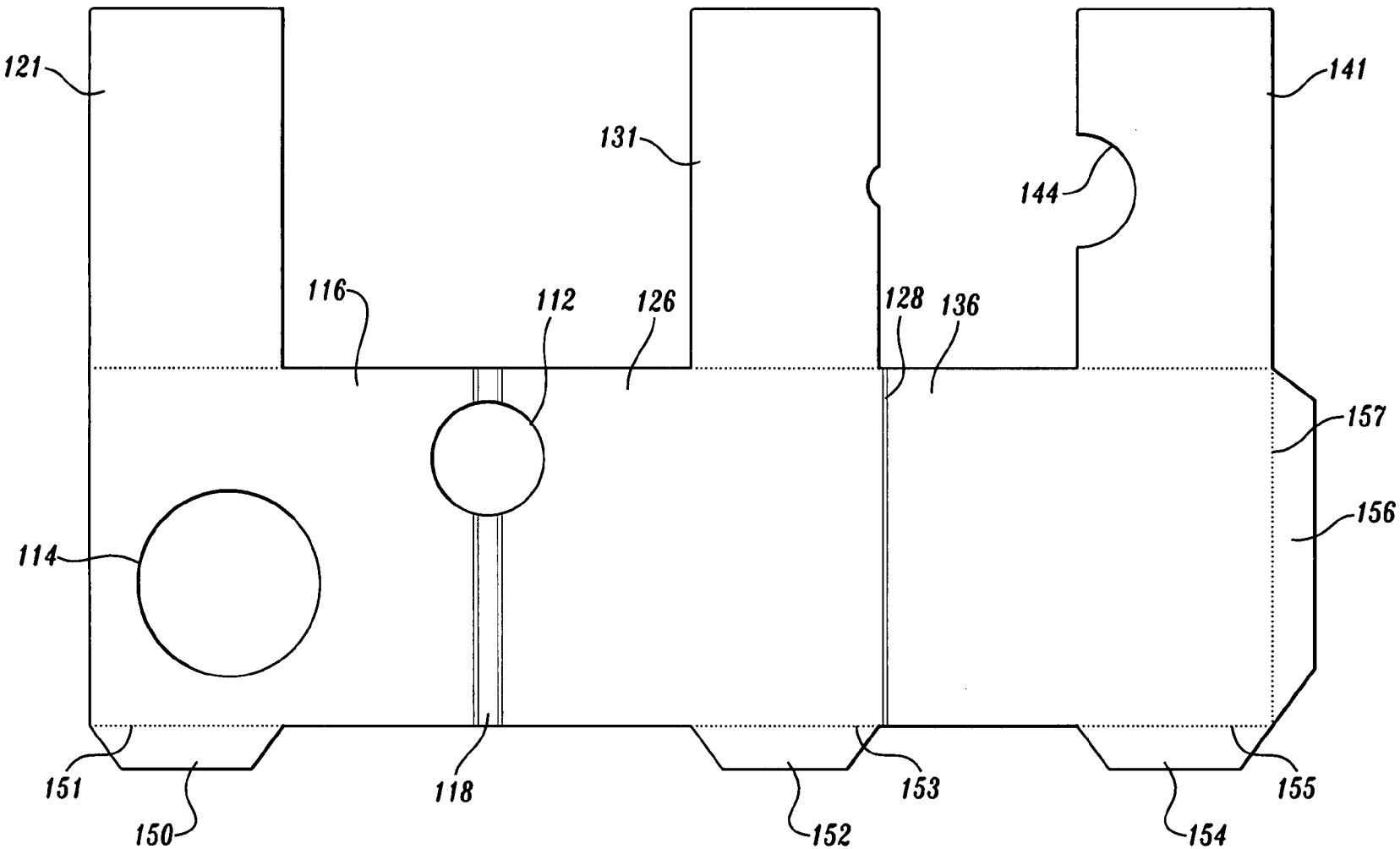
FIG. 6 is a plan view of the die-cut blank, showing the fold lines for making the sleeve portion of the sleeve assembly shown in FIG. 1.

A die-cut form 111 for the sleeve member 110 is shown in FIG. 6. The form 110 is a single, flat paperboard form, including the first end panel 116, middle panel 126, and second end panel 136, first and second retaining members 121,131, and pocket member 141. Front aperture 112, and spine aperture 114 are precut. It will be appreciated that although the front aperture 112 and the spine aperture 114 are shown as circular, other shapes are possible and contemplated by the present invention, including square, oval, and the like. It is also contemplated that there may be more than two apertures that permit additional or other portions of the placard 160 to be visible through the sleeve member 110, including, for example, a large number of relatively small apertures arranged in an aesthetically pleasing pattern.

Tab members 150, 152, 154, and 156 are positioned to be folded along corresponding fold lines 151, 153, 155, and 157, respectively. It will be apparent from FIG. 6 that, to assemble the sleeve member, the tab members 150, 152, 154, and 156 are folded inwardly and an adhesive is applied thereto. The retaining members 121, 131 and the pocket member 141 may then be folded downwardly to engage the appropriate tab members to form the sleeve member 110.

Figure 7:
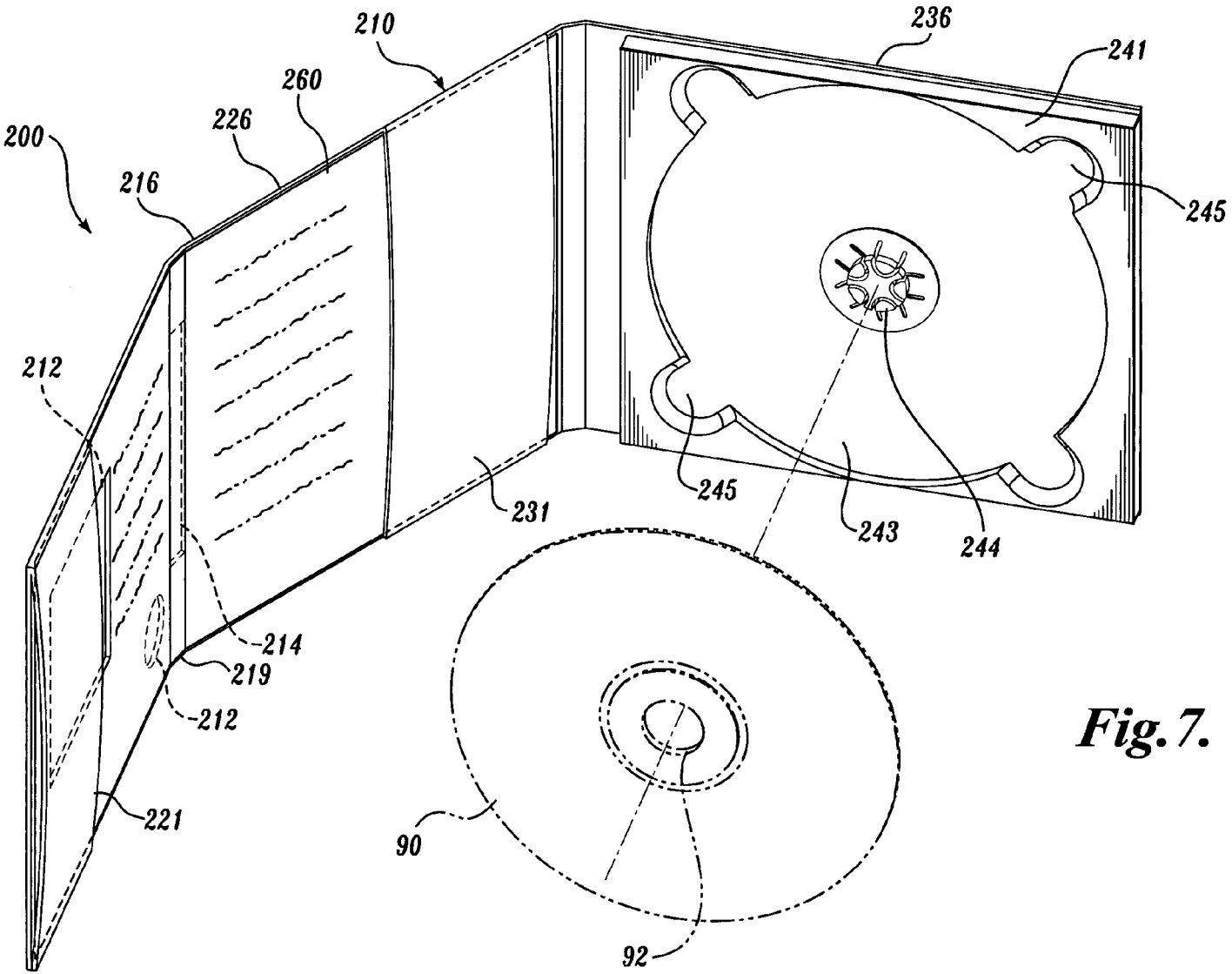
FIG. 7 is a perspective view of a second embodiment of a sleeve assembly according to the present invention, shown substantially fully open.

A second embodiment of a sleeve assembly 200 according to the present invention, is shown in FIG. 7, including a sleeve member 210 and a placard 260. In this embodiment, the multipanel (tripanel) sleeve member 210 includes a first end panel 216 hingedly connected to a middle panel 226 along spine 219 and an oppositely disposed second end panel 236 also hingedly connected to the middle panel 226. The first end panel 216 and middle panel 226 may be substantially similar to the first end panel 116 and middle panel 126, respectively, of the first embodiment described above. For example, the first end panel 216 and the middle panel 226 include first and second retaining members 221, 231 that slidably receive and retain the separable placard 260. One or both of the first end panel 216 and middle panel 226 include one or more apertures 212 (two shown in phantom) such that portions of the placard 260 are viewable through the apertures 212. A spine aperture 214 (shown in phantom) may also be provided such that portions of the placard 260 are visible therethrough.

The second end panel 236 of the present invention includes a rigid or semirigid disk holder 241 that may be made from a polymeric material—for example, a thermoplastic such as a polyethylene or polypropylene. The disk holder 241 defines a circular or substantially annular recess 243 that is sized to accommodate the digital media disk 90 (shown in phantom). A center, elastically flexible retaining member 244 that is sized to engage a center aperture 92 of the digital media disk 90 extends from the circular recess 243. The disk holder may include one or more peripheral indentations 245 (four shown) to facilitate removal of the digital media disk 90 from the disk holder 241. Such disk holders 241 are known in the art. The disk holder 241 is preferably permanently affixed to the second end panel 236—for example, with an adhesive or a secure double-sticky tape (not shown)—such that the disk holder 241 will not separate from the second end panel 236, even over repeated usage.

Figure 8A:
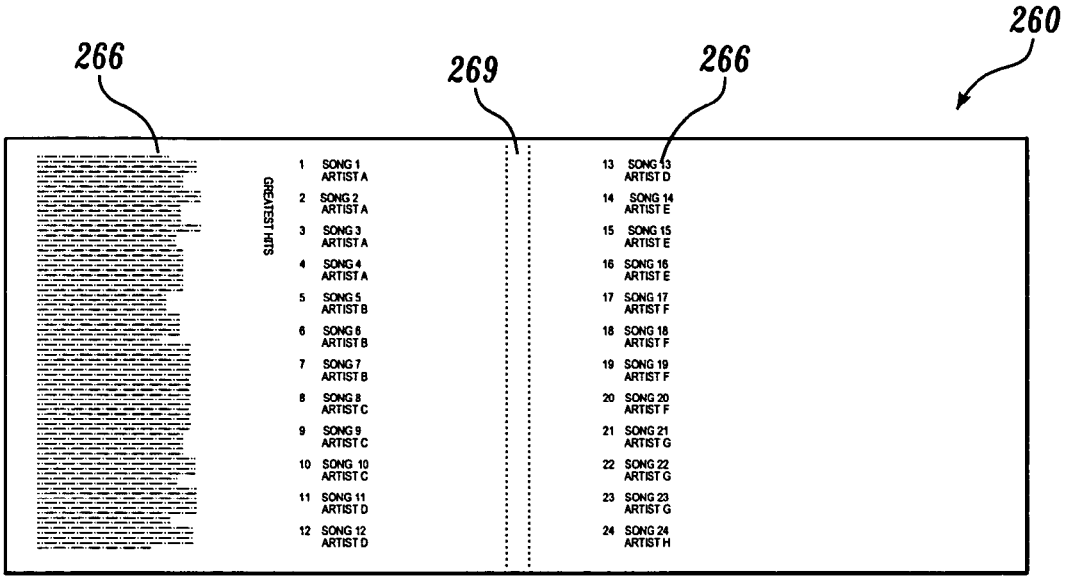
FIGS. 8A and 8B are front and back plan views, respectively, of the placard portion of the sleeve assembly shown in FIG. 7.
Figure 8B:
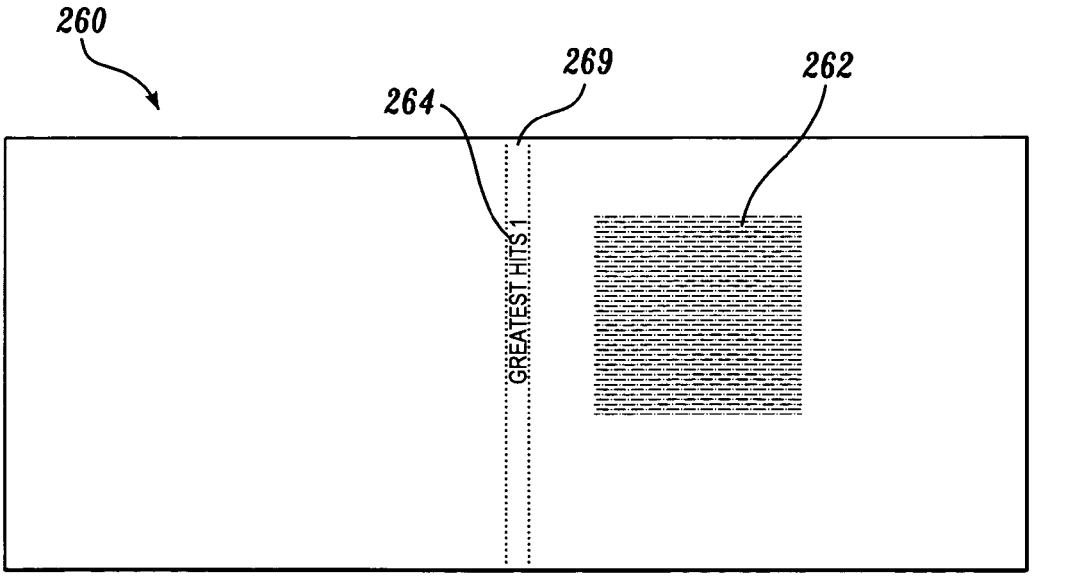

As seen most clearly in FIGS. 8A and 8B, the front side of the placard 260 (shown in FIG. 8A) preferably includes one or more first identifying indicia 262 (two shown) printed or otherwise disposed on the placard 260 to be visible through the front apertures 212 of the sleeve member 210, and second identifying indicia 264 printed or otherwise disposed on the spine 269 of the placard 260 to be visible through the spine aperture 214 of the sleeve member 210. The back side of the placard 260 (shown in FIG. 8B) may include additional identifying indicia 266—for example, specific information suitable for the particular digital media disk, such as a play list, user instructions, included features, copyright notice, or other product information—as discussed above. The placard 260 spine portion 269 is positioned to overlie the spine portion 219 of the sleeve member 210.

Figure 9:
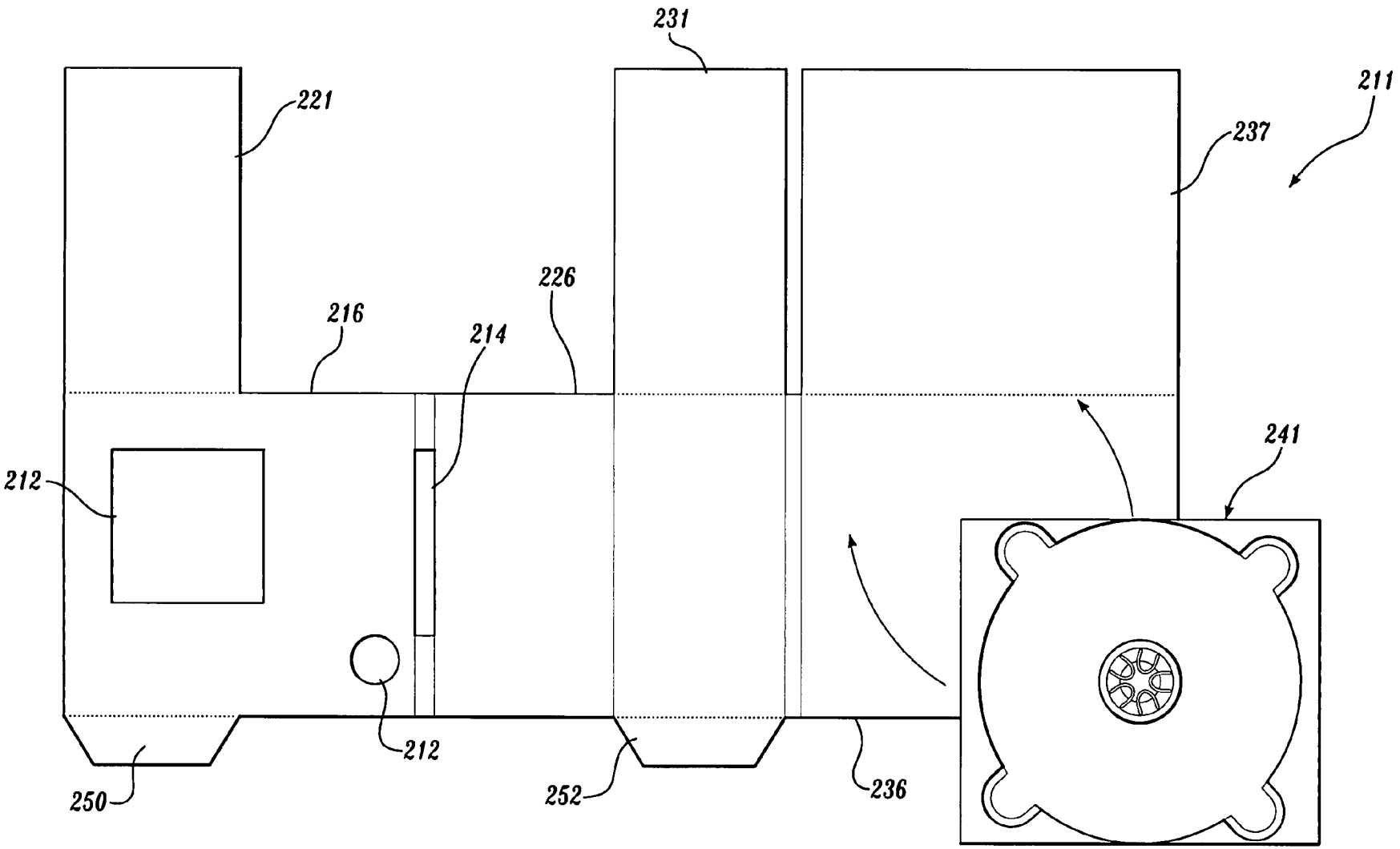
FIG. 9 is a plan view of a die-cut blank showing the tabs and fold lines for making the sleeve portion of the assembly shown in FIG. 7.

A die-cut paperboard form 211 for a preferred embodiment of the sleeve member 210 is shown in FIG. 9. The form 211 is a single, flat paperboard form, including the first end panel 216, middle panel 226, and second end panel 236 and first and second retaining members 221, 231. Front apertures 212 and spine aperture 214 are precut.

Tab members 250 and 252 are positioned to be folded as shown. In a preferred embodiment, the second end panel 236 includes reinforcing portion 237 that is folded to overlie and is bonded to the second end panel 236 to provide additional strength for supporting the disk holder 241. The disk holder 241 is shown with an arrow indicating placement on the second end panel 236 after folding over the reinforcing portion 237. The sleeve member 210 is formed by cutting the form 211, including the apertures 212, 214 as shown, and scoring along fold lines as desired, folding the tab portions 250, 252, retaining members 221, 231, reinforcing portion 237, and bonding to form the sleeve member 210. The disk holder 241 is then affixed to the second end panel 236.

Figures 10A, 10B:
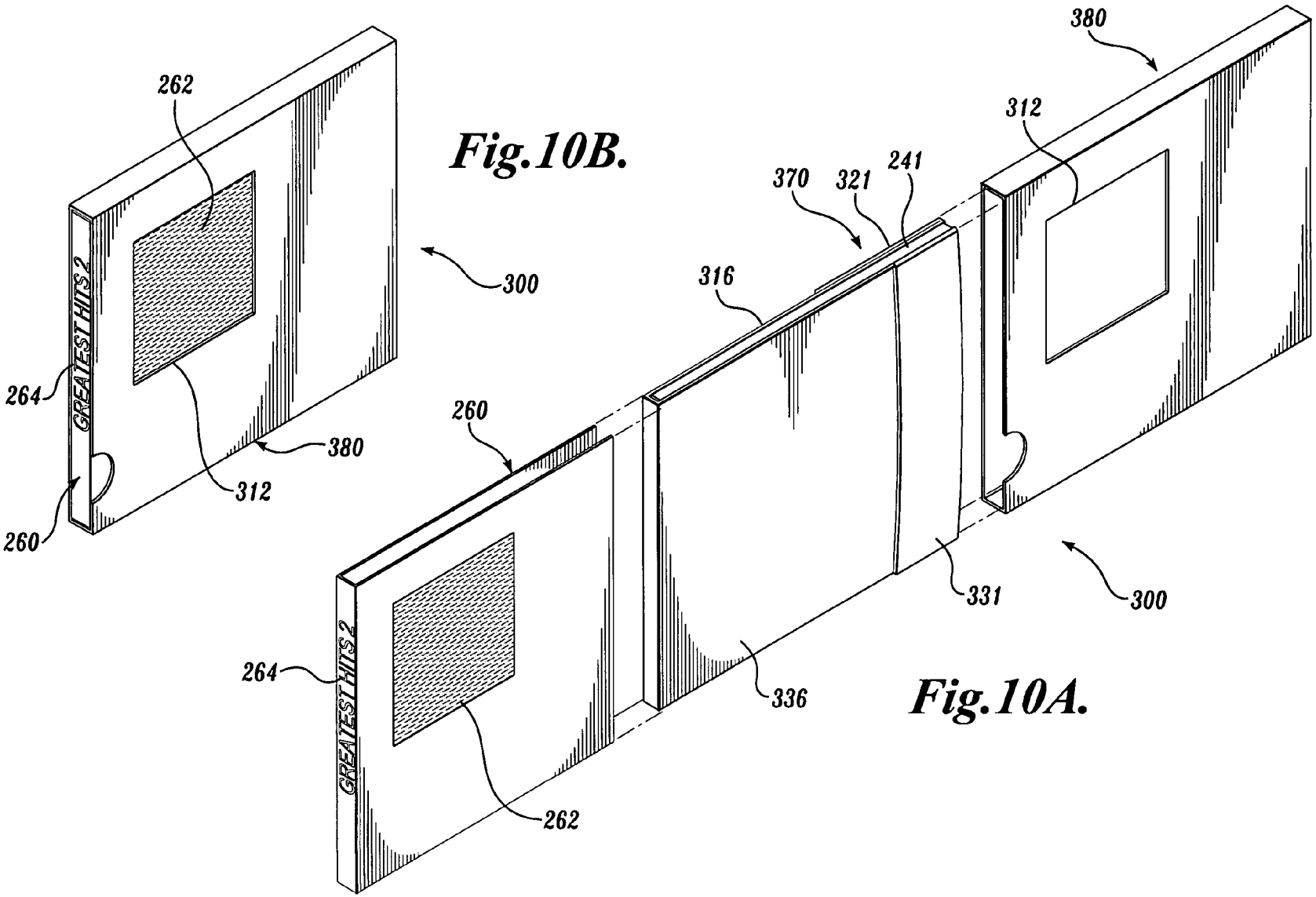
FIG. 10A is a partially exploded perspective view of a third embodiment of a sleeve assembly according to the present invention, wherein the sleeve member includes a hinged portion and a separable box portion.
FIG. 10B is a perspective view of the sleeve assembly shown in FIG. 10A, shown fully closed.
Figure 11A:
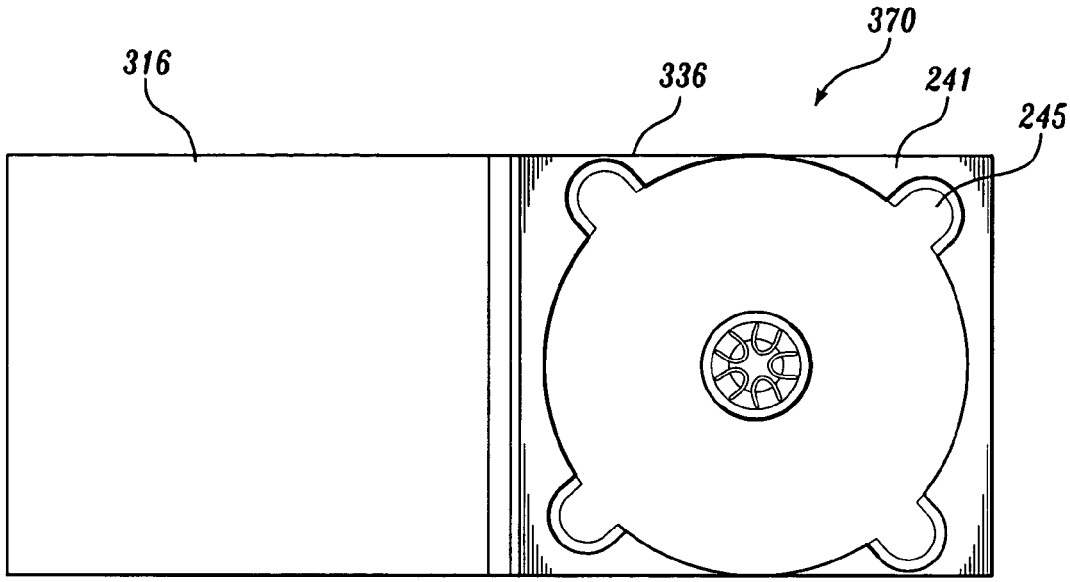
FIGS. 11A and 11B are front and back views, respectively, of the hinged portion of the sleeve assembly shown in FIG. 10A.
Figure 11B:
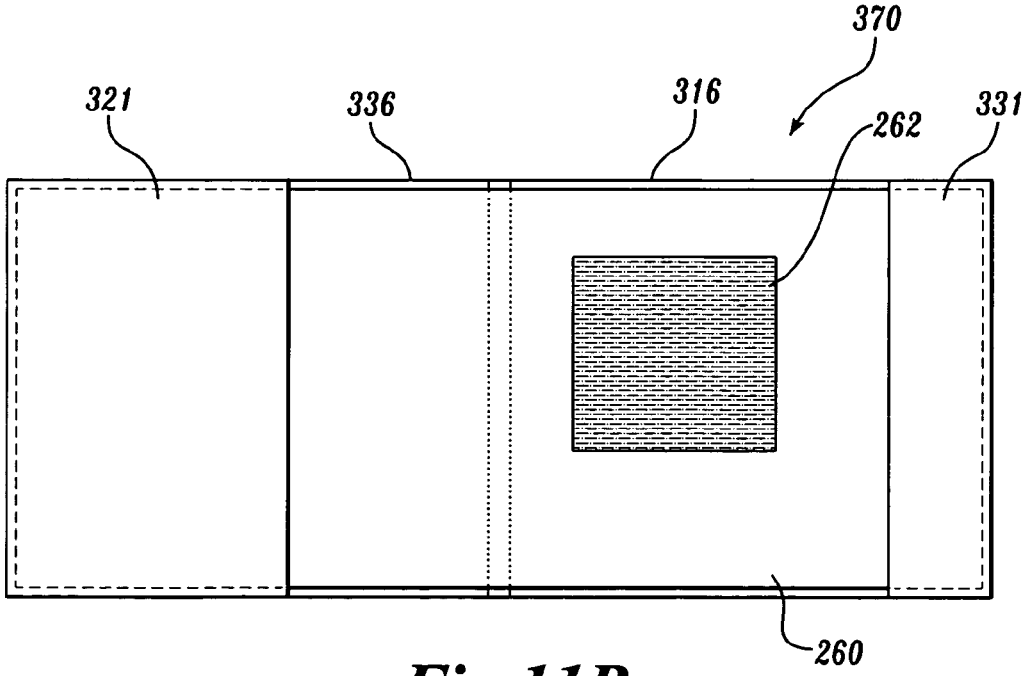

A third embodiment of a sleeve assembly 300 according to the present invention is shown in FIG. 10A (partially exploded view) and FIG. 10B (closed view). In this embodiment, a sleeve member includes a hinged portion 370 and a separable box portion 380. The hinged portion 370 is also shown in FIGS. 11A and 11B (with the placard 260) and includes a first panel 316 that is hingedly connected to a second panel 336, both preferably formed unitarily from a paperboard form. The second panel 336 has the disk holder 241 fixedly attached thereto for releasably retaining a digital media disk as discussed above. The disk holder 241 may be attached to the second panel 336—for example, by affixing double sided tape.

In contrast to the previously described embodiments, first and second retaining members 321, 331 are provided on a back side of the sleeve hinged portion 370, the first and second retaining members 321, 331 adapted to slidably engage the placard 260, which is described in detail above. As seen most clearly in FIG. 10A, the placard 260 generally wraps around the sleeve hinged portion 370, overlapping an outer surface of the folded hinged portion 370, and slides underneath the first and second retaining members 321, 331.

As shown in the figures, the hinged portion 370 and box portion 380 are sized such that the hinged portion 370, with the attached placard 260, is insertable into the boxed portion 380, providing a relatively snug fit. The boxed portion 380 includes one or more viewing apertures 312 that are positioned such that at least a portion of the first identifying indicia 262 is visible through the viewing apertures 312 when the hinged portion 370 is fully inserted into the box portion 380. Moreover, it will be appreciated from FIG. 10B that the second identifying indicia 264 is visible through the open end of the box portion 380 when the hinged portion 370 is appropriately inserted into the box portion 380. In the preferred embodiment, the sleeve box portion 380 is also made from a die-cut paperboard form folded and bonded to form the box portion 380, although it is contemplated that the box portion 380 may alternatively be made from other suitable materials.

It is contemplated that the sleeve assembly of the present invention will be particularly suitable in applications wherein a user-customizable selection of data is provided on digital media disks to a user. For example, a user may desire to purchase a customized play list of music tracks that are recorded onto a single compact disk. With the present invention, a generic or quasi-generic sleeve member, such as 110, 210, or 370 and 380 as described above, may be provided. The sleeve member may not include any information specific to the particular compact disk defined by the user, and therefore single, generic (or a small collection of generic) sleeve members may be used for many different users. Of course, the sleeve member may include indicia not related to the user's customized selection, such as a house trademark, commercial information, artwork, and the like.

A placard, for example, 160, 260 containing information specific to the compact disk—for example, the play list, track play times, artist, album, etc.—may then be easily printed, and provided for insertion onto the sleeve member. The placard may have other indicia printed thereon, including picture, artwork, and the like, at least some of which indicia may be user selectable.

The user may then insert the placard into the sleeve member and attach and/or enclose the compact disk in the sleeve member. The present invention, therefore, provides a convenient packaging system containing specific indicia regarding the disk, without requiring any special printing or marking of the sleeve member.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A sleeve assembly for holding a digital media disk, the sleeve assembly comprising:

a multipanel sleeve having a first sleeve panel with a first retaining member, a second sleeve panel with a second retaining member, the first sleeve panel hingedly connected to the second sleeve panel along a sleeve spine, and wherein the multipanel sleeve is movable between a closed position and an open position;

means for releasably attaching a digital media disk to the multipanel sleeve;

a multipanel placard having a first placard panel hingedly connected to a second placard panel along a placard spine, and identifying indicia printed on a portion of the placard, wherein the placard is sized to slidably engage the first and second retaining members such that the placard is removably retained on the multipanel sleeve; and a separable box sized to slidably receive the multipanel sleeve in the closed position, the box having at least one viewing aperture, the viewing aperture positioned such that at least a portion of the identifying indicia printed on the placard is viewable through the viewing aperture when the placard is retained on the multipanel sleeve and the multipanel sleeve is slidably received in the box.

2. The sleeve assembly of claim 1, wherein the means for releasably attaching the digital media disk to the multipanel sleeve comprises a semirigid polymeric disk holder having an annular recess sized to receive the digital media disk.

3. The sleeve assembly of claim 2, wherein the disk holder is fixedly attached to the second sleeve panel, and wherein the multipanel sleeve further comprises a separable narrow box portion that is sized to slidably receive the first and second sleeve portions, and wherein the viewing aperture is disposed through the box portion of the multipanel sleeve.

4. The sleeve assembly of claim 1, wherein the box further comprises at least a second viewing aperture and the placard further comprises at least a second identifying indicia, and wherein the second identifying indicia is viewable through the second viewing aperture when the placard is retained on the multipanel sleeve and the multipanel sleeve is slidably received in the box.

5. The sleeve assembly of claim 4, wherein the second viewing aperture comprises an open end of the box, and the second identifying indicia is printed on the placard spine.

6. The sleeve assembly of claim 2, wherein the multipanel sleeve comprises a first portion made from paperboard and the polymeric disk holder.

7. The sleeve assembly of claim 2, wherein the sleeve member is free of any identifying indicia.

8. The sleeve assembly of claim 2, wherein the placard is sized to substantially cover a top surface of the first and second panels of the sleeve member.

9. The sleeve assembly of claim 2, wherein the first and second retaining members are formed integrally by folding over a portion of the multipanel sleeve.

10. An assembly for holding a digital media disk, the assembly comprising:

a foldable sleeve member having a first panel and a second panel, each of the first and second panels having a front surface, a back surface, and a retaining member disposed on the back surface;

a disk holder attached to the front surface of the first panel; and a placard having identifying indicia printed thereon, the placard being removably retained by the retaining members such that the placard overlies the back surface of the first and second panel;

a separable box portion having front and back panels, the box portion slidably receiving the foldable sleeve member, the box portion having at least one viewing aperture through the front panel that is disposed such that at least a portion of the identifying indicia is visible through the viewing aperture.

11. The assembly of claim 10, wherein the box portion includes an open end, and the placard includes a second identifying indicia that is viewable through the open end of the box portion.

12. The assembly of claim 10, wherein the viewing aperture is rectangular.

13. The assembly of claim 10, wherein the disk holder is a semirigid polymeric disk holder having an annular recess sized to receive the digital media disk.

14. The assembly of claim 10, wherein the identifying indicia printed on the placard is a play list.

15. The assembly of claim 10, wherein the sleeve member is free of any markings particular to the received digital media disk.

* * * * *